US010556166B2

(12) United States Patent
Kim

(10) Patent No.: US 10,556,166 B2
(45) **Date of Patent: *Feb. 11, 2020**

(54) AUTOMATIC BATTING TRAINING APPARATUS

(71) Applicant: Moo Sung Kim, Daegu (KR)

(72) Inventor: Moo Sung Kim, Daegu (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/175,855

(22) Filed: Oct. 31, 2018

(65) Prior Publication Data

US 2019/0184258 A1 Jun. 20, 2019

(30) Foreign Application Priority Data

Dec. 14, 2017 (KR) ..... 10-2017-0172071

(51) Int. Cl.
*A63B 69/00* (2006.01)
*A63B 102/18* (2015.01)
*A63B 67/06* (2006.01)

(52) U.S. Cl.
CPC ..... *A63B 69/0091* (2013.01); *A63B 69/0002* (2013.01); *A63B 67/06* (2013.01); *A63B 69/0075* (2013.01); *A63B 2069/0008* (2013.01); *A63B 2102/18* (2015.10)

(58) Field of Classification Search
CPC ..... A63B 69/0091; A63B 69/0002; A63B 2102/18; A63B 2069/0008
USPC .... 473/451, 422, 454, 455; 124/79, 45, 51.1
See application file for complete search history.

(56) References Cited

U.S. PATENT DOCUMENTS 3,298,694 A * 1/1967 Turnau ..... A63B 57/0006 473/135
3,533,631 A * 10/1970 Hladek ..... A63B 57/0006 473/136
5,294,109 A * 3/1994 Meade ..... A63B 69/40 124/50
5,494,278 A 2/1996 Linden
5,647,338 A * 7/1997 Martin ..... A63B 69/0026 124/73
5,733,209 A * 3/1998 McIntyre, IV ..... A63B 69/409 473/133
6,146,289 A * 11/2000 Miller ..... A63B 69/0075 473/417
6,416,429 B1 * 7/2002 Pecoraro ..... A63B 69/0002 124/6
6,443,859 B1 * 9/2002 Markin ..... A63B 69/406 124/6

(Continued)

FOREIGN PATENT DOCUMENTS

KR 10-1999-0082647 A 11/1999

*Primary Examiner* — Mitra Aryanpour
(74) *Attorney, Agent, or Firm* — Revolution IP, PLLC

(57) ABSTRACT

An automatic batting training apparatus includes: a bottom part; a hopper assembly disposed on one side of the bottom part to sequentially discharge a plurality of balls stored therein; and a driving assembly disposed on the other side of the bottom part and including a transfer module adapted to transfer the balls discharged from the hopper assembly in a vertical direction and an ascending/descending module having a tee stand disposed movable upward and downward in such a manner as to allow the balls received from the transfer module to be seated one by one onto top thereof to perform tee batting.

10 Claims, 10 Drawing Sheets

(56) References Cited

U.S. PATENT DOCUMENTS

| | | | | |
|---|---|---|---|---|
| 6,684,872 | B2 * | 2/2004 | Kao | A63B 47/002 124/56 |
| 7,874,942 | B2 * | 1/2011 | Auzoux | A63B 67/06 473/417 |
| 8,425,352 | B1 * | 4/2013 | Loduca | A63B 69/38 473/418 |
| 10,112,097 | B2 * | 10/2018 | Loduca | A63B 69/0075 473/451 |
| 10,245,489 | B2 * | 4/2019 | Kim | A63B 69/407 473/451 |

* cited by examiner

AUTOMATIC BATTING TRAINING APPARATUS

BACKGROUND OF THE INVENTION

Field of the Invention

The present invention relates to a batting training apparatus, and more particularly, to an automatic batting training apparatus that is capable of automatically seating a ball onto a tee stand to allow a batter to easily perform batting training.

Background of the Related Art

As people who are involved in leisure activities are increased, they make various kinds of sports teams to watch sports games and further to directly play the games, thereby improving their team chemistry and their own health.

For example, members of society in baseball teams, soccer teams, or basketball teams meet on a playground regularly or irregularly to play the games or perform physical training or technique practicing, thereby improving their game ability.

In case of the baseball among various sports, batting training is necessarily needed. General batting training is conducted by allowing a ball thrown to a batter from a technique coach to be hit against a bat of the batter.

However, such batting training through the coach or another person needs at least one person who throws the ball to the batter, and in this case, especially, safety accidents may happen.

In detail, if the ball hit by the batter flies to the person who throws the ball to the batter or if the bat is released from the batter' hands, very serious damages may be caused.

On the other hand, a conventional ball batting training machine is disclosed in Korean Patent Application Laid-open No. 1999-0082647, wherein the ball batting training machine includes a movable member and a ball support arm having one end fixed to the movable member and the other side end having a ball seated thereonto. However, the conventional ball batting training machine does not disclose any technical subject of the present invention.

SUMMARY OF THE INVENTION

Accordingly, the present invention has been made in view of the above-mentioned problems occurring in the prior art, and it is an object of the present invention to provide an automatic batting training apparatus that is capable of automatically feeding a ball to a batter through a tee stand to allow the batter to perform batting training alone.

To accomplish the above-mentioned object, according to the present invention, there is provided an automatic batting training apparatus including: a bottom part; a hopper assembly disposed on one side of the bottom part to sequentially discharge a plurality of balls stored therein; and a driving assembly disposed on the other side of the bottom part and comprising a transfer module adapted to transfer the balls discharged from the hopper assembly in a vertical direction and an ascending/descending module having a tee stand disposed movable upward and downward in such a manner as to allow the balls received from the transfer module to be seated one by one onto top thereof to perform tee batting, wherein the driving assembly has a transfer space formed therein in a vertical direction to transfer the balls received from the hopper assembly in the vertical direction and a tee stand accommodation space formed parallel with the transfer space to accommodate the tee stand therein.

According to the present invention, desirably, the hopper assembly includes: a hopper case having a hollow portion formed therein to store the balls therein; a rotating body rotatably disposed in the hollow portion of the hopper case and having a rotating shaft located at the center thereof and a plurality of cylindrical ball accommodation holes radially formed around the rotating shaft; a support frame having one side coupled to the bottom part and a support plate disposed on the other side thereof in such a manner as to be spaced apart from the underside peripheries of the ball accommodation holes; and a first motor located under the support plate in such a manner as to be connected to the rotating shaft to rotate the rotating body.

According to the present invention, desirably, a distance between the underside peripheries of the ball accommodation holes and the support plate is smaller than a diameter of the ball.

According to the present invention, desirably, the support plate has a ball discharge hole formed on one side thereof to correspond to one ball accommodation hole and a rotating shaft through hole formed on the other side thereof in such a manner as to pass the rotating shaft therethrough, and the hopper assembly has a protruding plate protruding from an inner side of the hopper case corresponding to the ball discharge hole in such a manner as to cover a portion of the top of the ball accommodation hole.

According to the present invention, desirably, the transfer module includes: a second motor; a rotating rod rotating along with the rotation of the second motor and having a screw thread formed on the outer peripheral surface thereof; and a ball transfer body reciprocating up and down along with the rotation of the rotating rod and having a rod accommodation portion formed on one side thereof to accommodate the rotating rod therein and a seating portion formed on the other side thereof to seat the ball discharged from the hopper assembly thereonto.

According to the present invention, desirably, the transfer space of the transfer module is partitioned into a first transfer space in which the ball transfer body reciprocates up and down and a second transfer space formed above the first transfer space, and a locking member is disposed between the first transfer space and the second transfer space to prevent the ball entering the second transfer space through the ball transfer body from falling down.

According to the present invention, desirably, the second transfer space has an intermediate separation plate disposed on one side adjacent to the tee stand accommodation space and an escape prevention plate disposed on the other side facing the intermediate separation plate.

According to the present invention, desirably, the intermediate separation plate has a guide groove formed on top thereof to guide the ball to the ascending/descending module, and the escape prevention plate has a lower escape prevention plate formed in the vertical direction and an upper escape prevention plate disposed on top of the lower escape prevention plate in such a manner as to be inclined toward the intermediate separation plate as the upper escape prevention plate goes upwards.

According to the present invention, desirably, the ascending/descending module includes: a third motor; a first pulley coupled to the third motor and rotating along with the rotation of the third motor; a second pulley vertically spaced apart from the first pulley above the first pulley; a belt member adapted to connect the first pulley and the second pulley; and a bracket adapted to move the tee stand up and down along with the rotation of the third motor and having one side fixedly coupled to the belt member and the other side coupled to the tee stand.

According to the present invention, desirably, the automatic batting training apparatus further includes: a control module for controlling at least one of the hopper assembly and the driving assembly; and a power storage part for supplying power to at least one of the hopper assembly, the driving assembly, and the control module.

According to the present invention, desirably, states and abnormalities of the hopper assembly, the driving assembly, the control module, and the power storage part are outputted, and the automatic batting training apparatus further includes a touch screen panel through which control commands are inputted directly by a batter.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Figure 1:
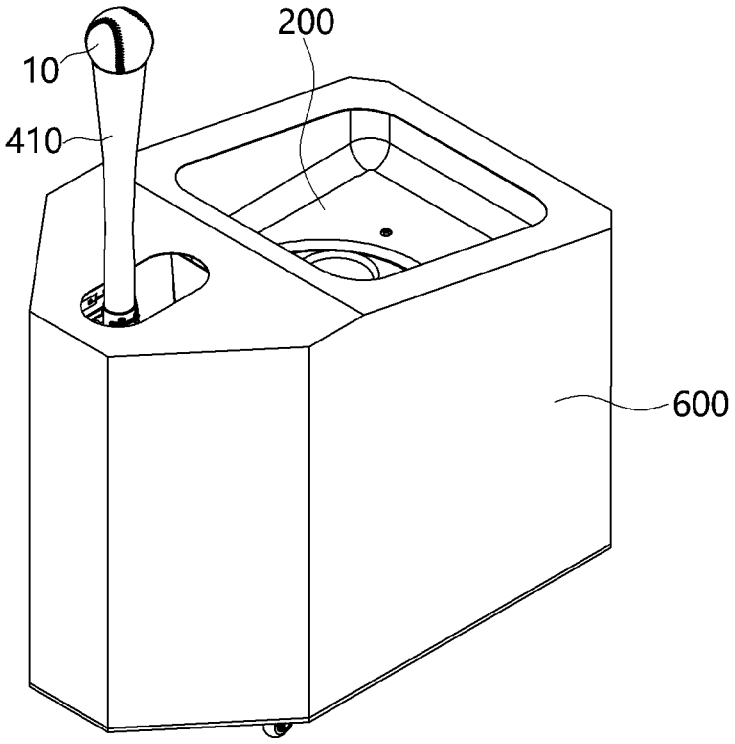
FIG. 1 is a perspective view showing an automatic batting training apparatus according to the present invention.

The present invention is disclosed with reference to the attached drawings wherein the corresponding parts in the embodiments of the present invention are indicated by corresponding reference numerals and the repeated explanation on the corresponding parts will be avoided.

In the description, if it is determined that the detailed explanation on the well known technology related to the present invention makes the scope of the present invention not clear, the explanation will be avoided for the brevity of the description. The following drawings herein illustrate preferred embodiments of the present invention and serve to facilitate the general understanding of the scope of the present invention, together with the detailed description of the present invention. Therefore, the present invention is not limitedly interpreted only with the attached drawings.

Hereinafter, an explanation on an automatic batting training apparatus according to the present invention will be in detail given with reference to the attached drawings.

Figure 2:
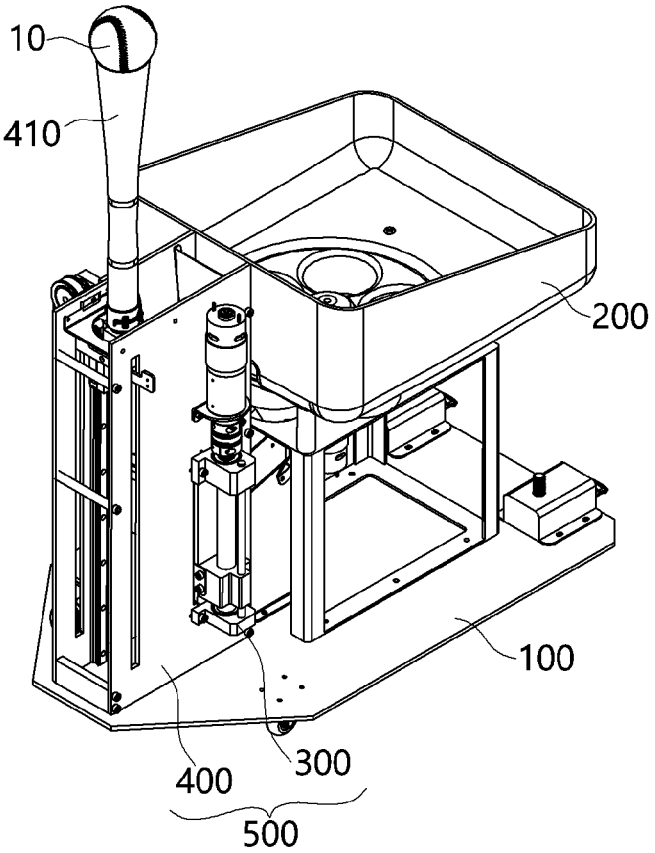
FIG. 2 is a perspective view showing the automatic batting training apparatus according to the present invention, wherein a case is removed.

As shown in FIGS. 1 and 2, first, an automatic batting training apparatus according to the present invention largely includes a bottom part 100, a hopper assembly 200, a driving assembly 500, and a case 600.

A plurality of balls 10 stored in the hopper assembly 200 are transferred to the driving assembly 500, and after they are seated on top of a tee stand 410 by means of a transfer module 300 of the driving assembly 500, the tee stand 410 is raised vertically to allow a batter to perform batting training.

Now, an explanation on the respective parts of the automatic batting training apparatus according to the present invention will be in detail given with reference to FIGS. 3 to 9.

Figure 3:
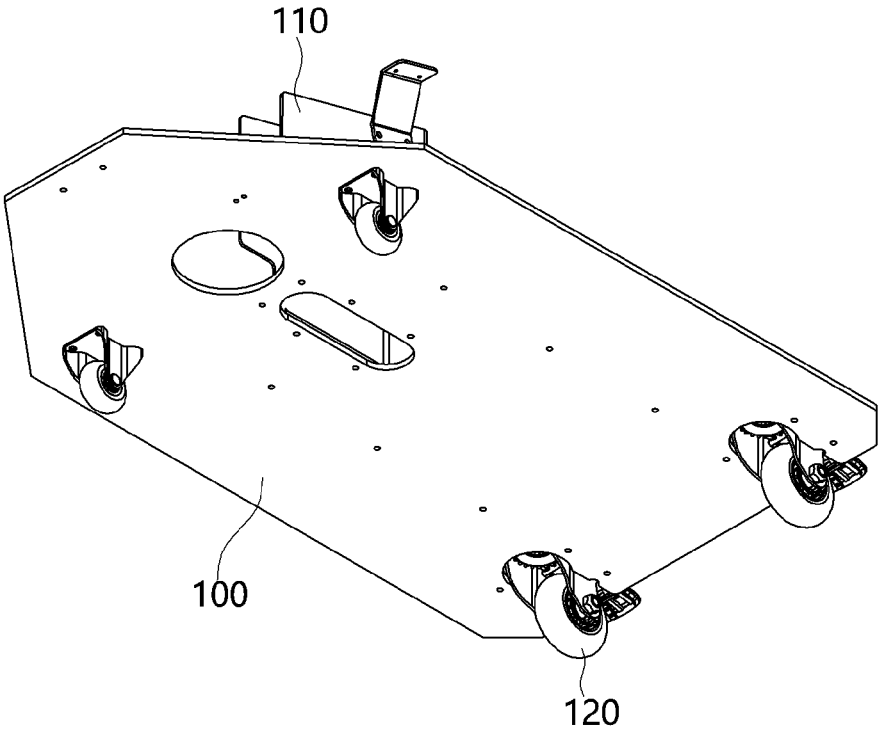
FIGS. 3 and 4 are perspective views showing a bottom part of the automatic batting training apparatus according to the present invention.
Figure 4:
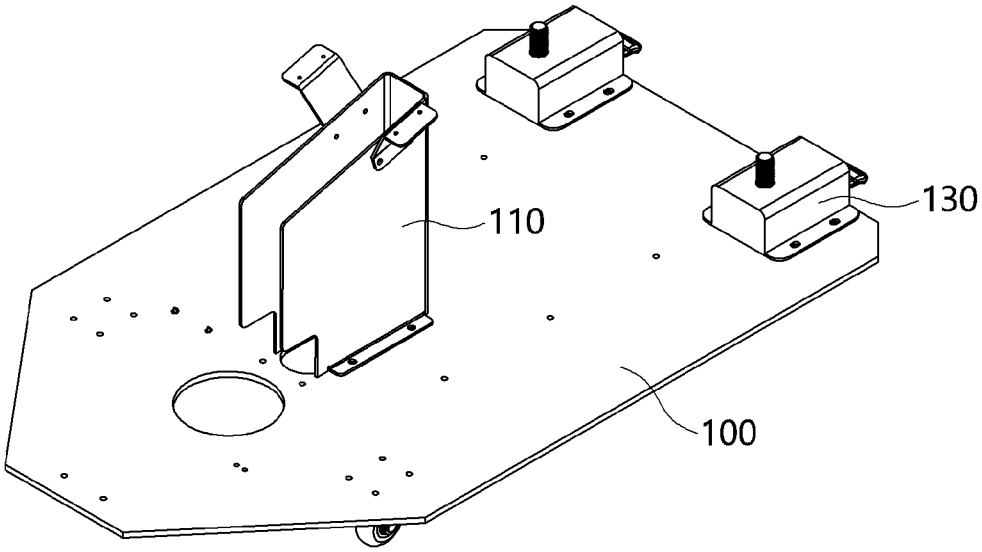

First, the bottom part 100 is adapted to seat the hopper assembly 200 and the driving assembly 500 on one side and the other side thereof, and as shown in FIGS. 3 and 4, the bottom part 100 includes a ball supply guide 110, casters 120, and lockers 130.

The ball supply guide 110 serves to gently guide the ball 10 discharged from the hopper assembly 200 as will be discussed later toward the driving assembly 500, in detail, toward a transfer module 300 of the driving assembly 500.

So as to reduce the entire weight of the ball supply guide 110, as shown in FIGS. 3 and 4, the ball supply guide 110 is desirably inclinedly formed to allow the ball 10 moving from the hopper assembly 200 disposed thereabove to be transferred to the transfer module 300.

So as to prevent the ball 10 from escaping from the ball supply guide 110 to the outside and to reduce the entire weight of the automatic batting training apparatus, moreover, the ball supply guide 110 desirably has a groove formed thereon, and the width of the groove is smaller than a diameter of the ball 10.

So as to ensure easy mobility of the automatic batting training apparatus according to the present invention, on the other hand, the casters 120 are located on the underside of the bottom part 100.

If the batting training is carried out after the automatic batting training apparatus moves to a desired place, further, the automatic batting training apparatus has to be fixed to the desired place, and accordingly, the lockers 130 are desirably provided to brake the casters 120.

Figure 5:
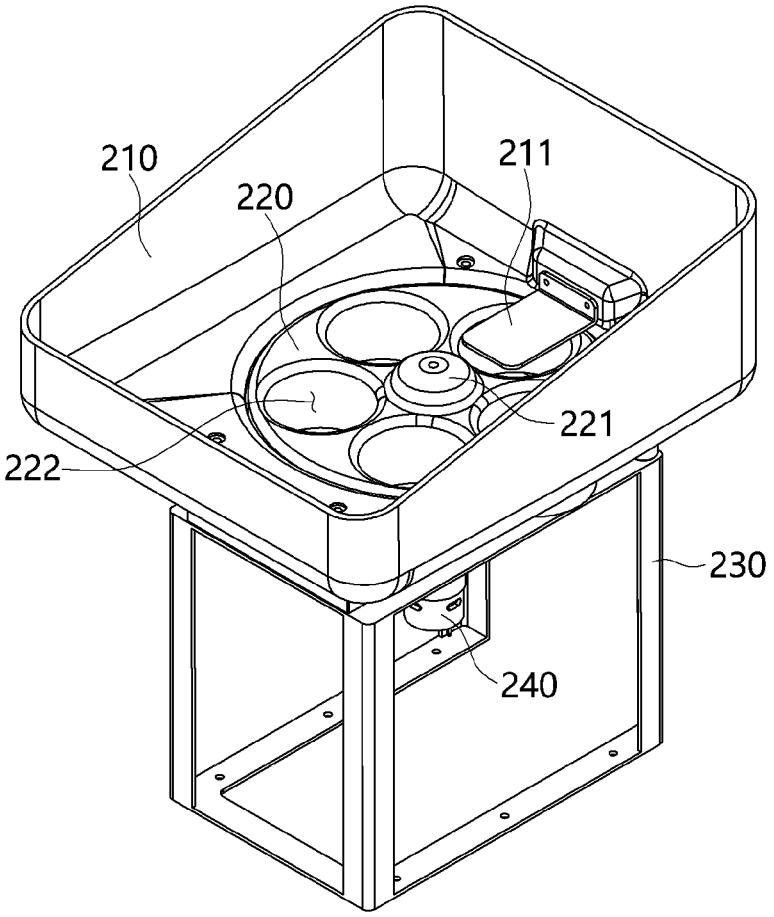
FIGS. 5 and 6 are perspective views showing a hopper assembly of the automatic batting training apparatus according to the present invention.
Figure 6:
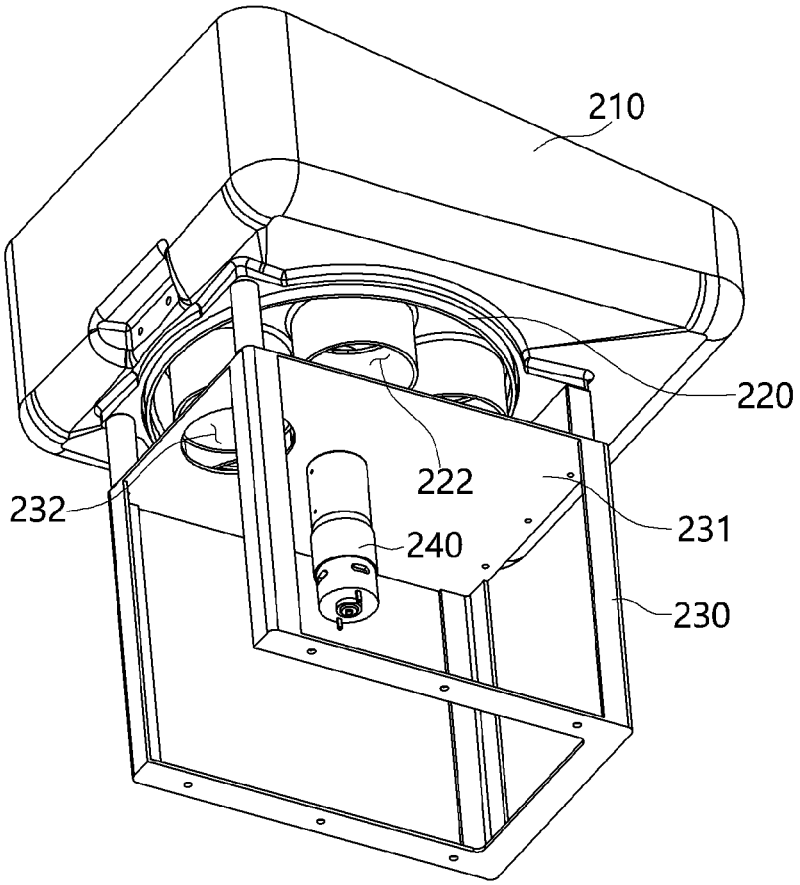
Figure 7:
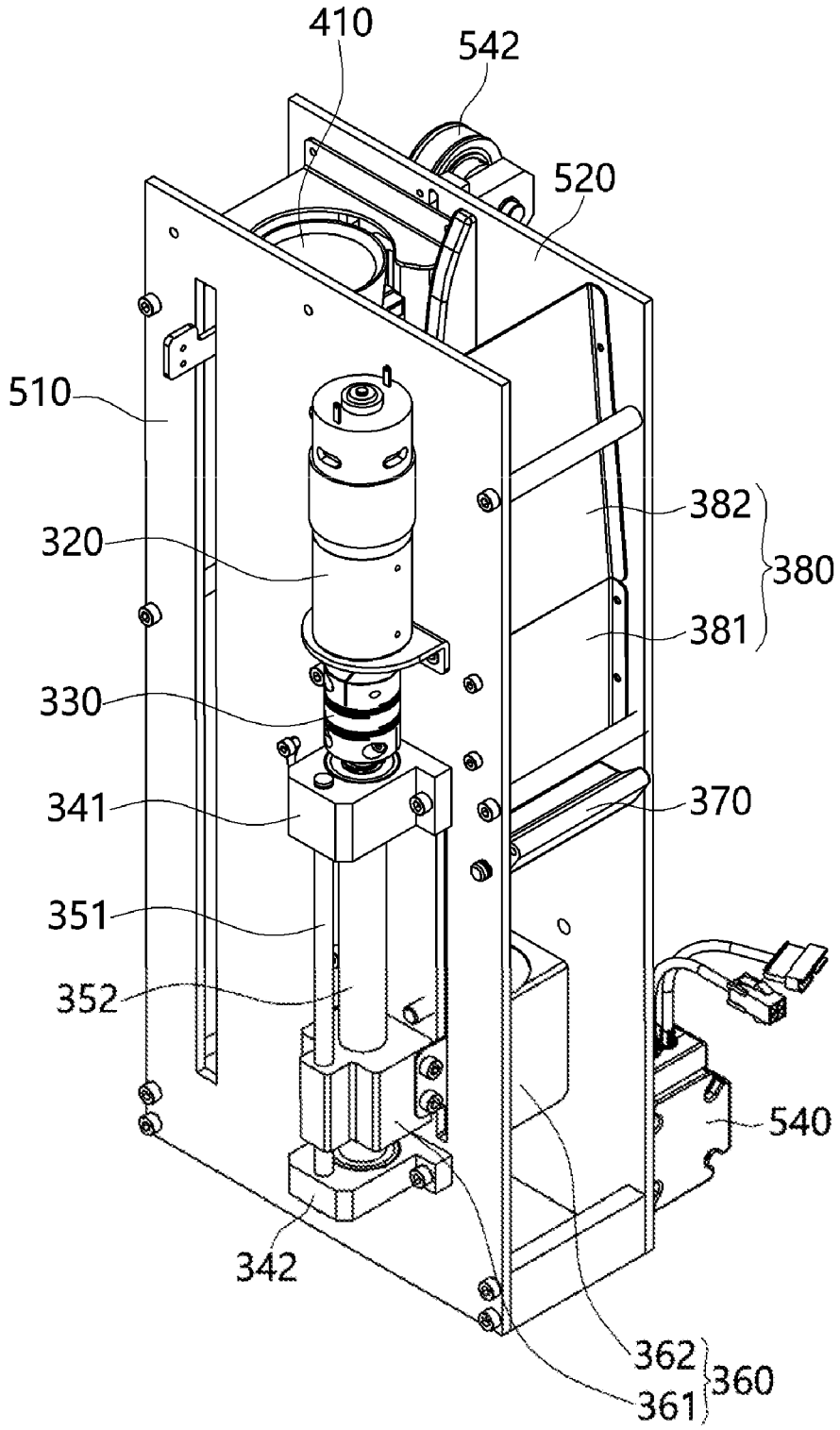
FIGS. 7 and 8 are perspective views showing a driving assembly of the automatic batting training apparatus according to the present invention.
Figure 8:
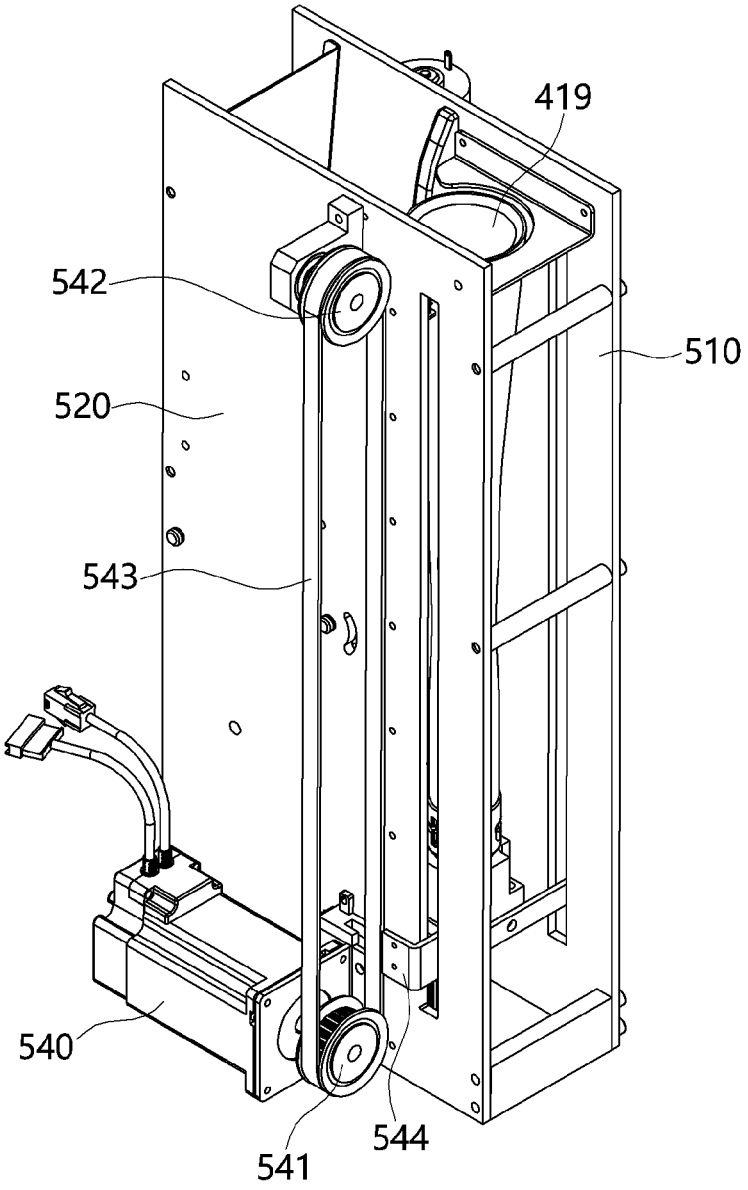

Next, an explanation on the hopper assembly 200 of the automatic batting training apparatus according to the present invention will be in detail given with reference to FIGS. 5 and 6.

According to the present invention, the hopper assembly 200 of the automatic batting training apparatus is disposed on one side of the bottom part 100 to sequentially discharge the balls 10 stored therein.

To this end, as shown in FIGS. 5 and 6, the hopper assembly 200 includes a hopper case 210, a rotating body 220, a support frame 230, and a first motor 240.

The hopper case 210 is open on top thereof to accommodate the plurality of balls 10 therein, and as shown in FIGS. 5 and 6, the hopper case 210 has a square base. Otherwise, the hopper case 210 may have a circular base.

The hopper case 210 has a hollow hole formed on the center of the base, and the rotating body 220 is rotatably disposed in the interior of the hollow hole.

The rotating body 220 has a rotating shaft 221 located at the center thereof and a plurality of ball accommodation holes 222 radially formed around the rotating shaft 221.

A diameter of each ball accommodation hole 222 is somewhat larger than a diameter of the ball 10 so as to accommodate only one ball 10 into each ball accommodation hole 222, and also, a height of each ball accommodation hole 222 is somewhat higher than the diameter of the ball 10 to allow the ball 10 to be gently accommodated into each ball accommodation hole 222, while preventing the plurality of balls 10 from entering each ball accommodation hole 222 at one time.

One side of the support frame 230 is coupled to the bottom part 100, and the support frame 230 has a support plate 231 disposed on the other side thereof in such a manner as to be spaced apart from the underside periphery of the rotating body 220, in detail, from the underside peripheries of the ball accommodation holes 222.

On the other hand, the balls 10 have to be one by one supplied from the hopper assembly 200 to the driving assembly 500 so as to prevent the ball 10 from being locked while being transferred, and if one ball accommodation hole 222 moves to a given position, only the ball 10 of the ball accommodation hole 222 is desirably moved down and transferred to the ball supply guide 110.

Accordingly, the support plate 231 has a ball discharge hole 232 formed on an area corresponding to the given position so as to discharge the balls 10 accommodated in the ball accommodation holes 222 downwards, and further has a rotating shaft through hole formed on a center thereof to pass a rotating shaft 221 of the rotating body 220 therethrough downward in such a manner as to be connected to the first motor 240 as will be discussed later.

So as to prevent the balls 10 accommodated in the ball accommodation holes 222 located on the area which does not correspond to the ball discharge hole 232 from escaping from the ball accommodation holes 222 to the outside, moreover, a distance between the underside peripheries of the ball accommodation holes 222 and the support plate 231 is desirably smaller than the diameter of the ball 10.

The first motor 240 is located under the support plate 231 in such a manner as to be connected to the rotating shaft 221 and serves to rotate the rotating body 220 under the control of a control module as will be discussed later.

Especially, the rotating body 220 does not rotate always and has to rotate at the moment when only one ball 10 is transferred to the ball supply guide 110 through the ball discharge hole 232.

The first motor 240 does not operate normally, but if there is a need to transfer the ball 10 to the driving assembly 500, the first motor 240 moves the rotating body 220 by a predetermined angle and then stops its operation.

For example, as shown in FIGS. 5 and 6, if five ball accommodation holes 222 are formed on the rotating body 220, the first motor 240 operates to allow the rotating body 220 to rotate by 72° (360°/5).

If two or more balls 10 entangledly enter the inlet sides of the ball accommodation holes 222, on the other hand, the balls 10 cannot be gently transferred to the ball supply guide 110.

So as to solve such problem, the hopper assembly 200 has a protruding plate 211 protruding from an inner side area of the hopper case 210 which corresponds to the ball discharge hole 232 in such a manner as to cover a portion of the top of the ball accommodation hole 222.

Through the above-mentioned operation of the hopper assembly 200, the ball 10 is transferred to the driving assembly 500 through the ball supply guide 110 of the bottom part 100, and hereinafter, an explanation on a detailed configuration and an operation of the driving assembly 500 of the automatic batting training apparatus according to the present invention will be in detail given with reference to FIGS. 7 to 11.

The driving assembly 500 of the automatic batting training apparatus according to the present invention is disposed on the other side of the bottom part 100, and in detail, it is disposed adjacent to the side of the hopper assembly 200.

The driving assembly 500 includes the transfer module 300 and an ascending/descending module 400, and the transfer module 300 and the ascending/descending module 400 are formed integrally with each other, thereby substantially reducing the volume of the automatic batting training apparatus.

The transfer module 300 receives the ball 10 discharged from the hopper assembly 200 from the ball supply guide 110 and thus transfers the ball 10 in a vertical direction. The ascending/descending module 400 includes the tee stand 410 disposed at the interior thereof in such a manner as to be movable upwards and downwards, so that the ball 10 received from the transfer module 300 is seated onto top of the tee stand 410, thereby making it possible for the batter to perform tee batting.

Figure 9:
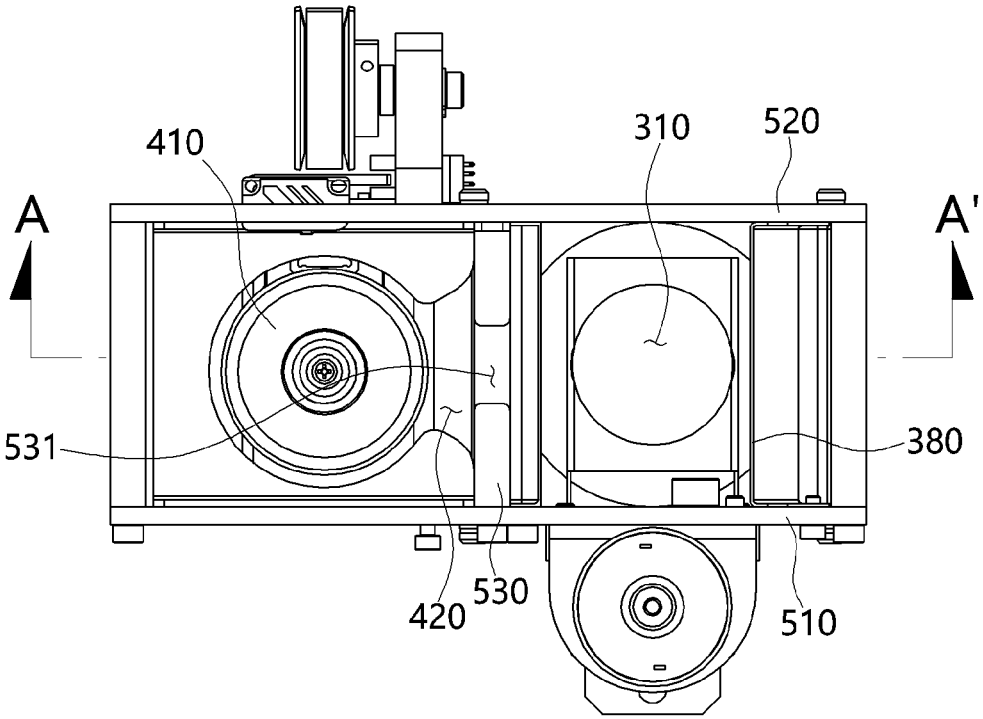
FIG. 9 is a plan view showing the driving assembly of the automatic batting training apparatus according to the present invention.

Particularly, the driving assembly 500 is configured to be surrounded with a first panel 510 and a second panel 520 disposed facingly to the first panel 510, and as shown in FIG. 9, the interior of the driving assembly 500 is partitioned in a vertical direction in such a manner as to form a transfer space 310 on one side thereof and a tee stand accommodation space 420 on the other side thereof.

The transfer space 310 is a space formed vertically to vertically move the ball 10 received from the hopper assembly 200, and the tee stand accommodation space 420 is parallel with the transfer space 310 in such a manner as to allow the tee stand 410 to be accommodated in an interior thereof.

First, the transfer module 300 of the driving assembly 500 will be explained below, and the transfer module 300 includes a second motor 320, a rotating rod 330, and a ball transfer body 340.

The second motor 320 is driven by means of the control module as will be discussed later, and the rotating rod 330 is coupled to the second motor 320 in such a manner as to rotate along with the rotation of the second motor 320 and has a screw thread formed on the outer peripheral surface thereof.

Further, the rotating rod 330 rotates along with the rotation of the second motor 320, but a reducer is located between the second motor 320 and the rotating rod 330 to reduce the rotation of the second motor 320, so that the rotating rod 330 desirably rotates along with the rotation of an output shaft of the reducer.

The ball transfer body 340 includes a rod accommodation portion 341 formed on one side thereof and a seating portion 342 formed on the other side thereof.

The rod accommodation portion 341 has a reciprocating protrusion formed on an interior thereof in such a manner as to be inserted into the inner peripheral surface of the rotating rod 330, and if the second motor 320 is driven to rotate the rotating rod 330, the reciprocating protrusion moves along the screw thread formed on the outer peripheral surface of the rotating rod 330, so that the ball transfer body 340 reciprocates up and down.

Further, an upper fixing member and a lower fixing member are disposed to restrict the vertical movement of the ball transfer body 340, so that the ball transfer body 340 is limited in the reciprocating moving path thereof.

Further, a guide rod 351 is disposed between the upper fixing member and the lower fixing member to stably guide the linear reciprocating motion of the ball transfer body 340.

The seating portion 342 is formed integrally with the rod accommodation portion 341 and thus reciprocates up and down by means of the up and down reciprocating motion of the rod accommodation portion 341. If the seating portion 342 is located at the lowermost end of the ball transfer body 340, it has to be disposed to easily accommodate the ball 10 received from the ball supply guide 110 therein.

On the other hand, the transfer space 310 of the transfer module 300 is partitioned into a first transfer space in which the ball transfer body 340 reciprocates up and down and a second transfer space formed above the first transfer space, and a locking member 350 is disposed between the first transfer space and the second transfer space.

The locking member 370 serves to prevent the ball 10 entering the second transfer space through the ball transfer body 340 from falling down, that is, from entering again the first transfer space.

In detail, the ball transfer body 340 is configured to reciprocate only in the first transfer space, and if the ball transfer body 340 is located at the lowermost end thereof, it receives the ball 10 from the ball supply guide 110. As the second motor 320 is driven, next, the ball transfer body 340 moves upward in the state of accommodating the ball 10 therein.

Figure 10:
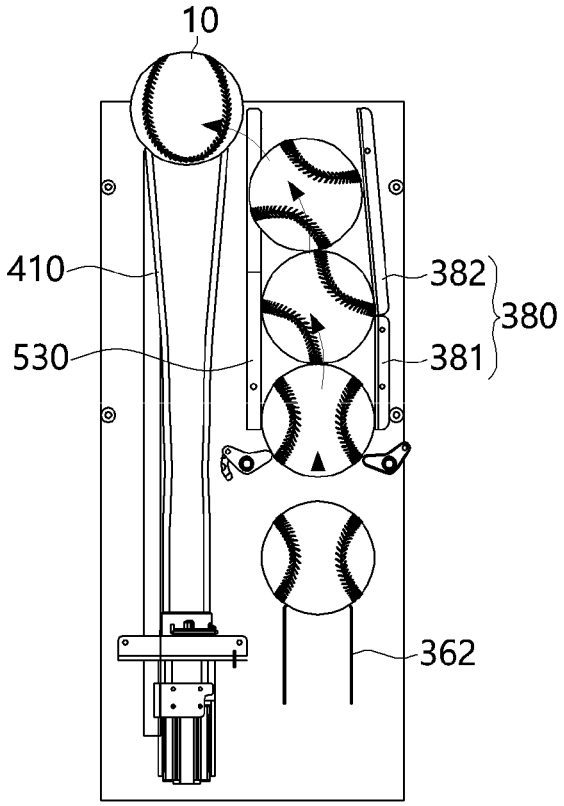
FIGS. 10 and 11 are sectional views taken along the line A-A' of FIG. 9, which show the operating states of the automatic batting training apparatus according to the present invention.
Figure 11:
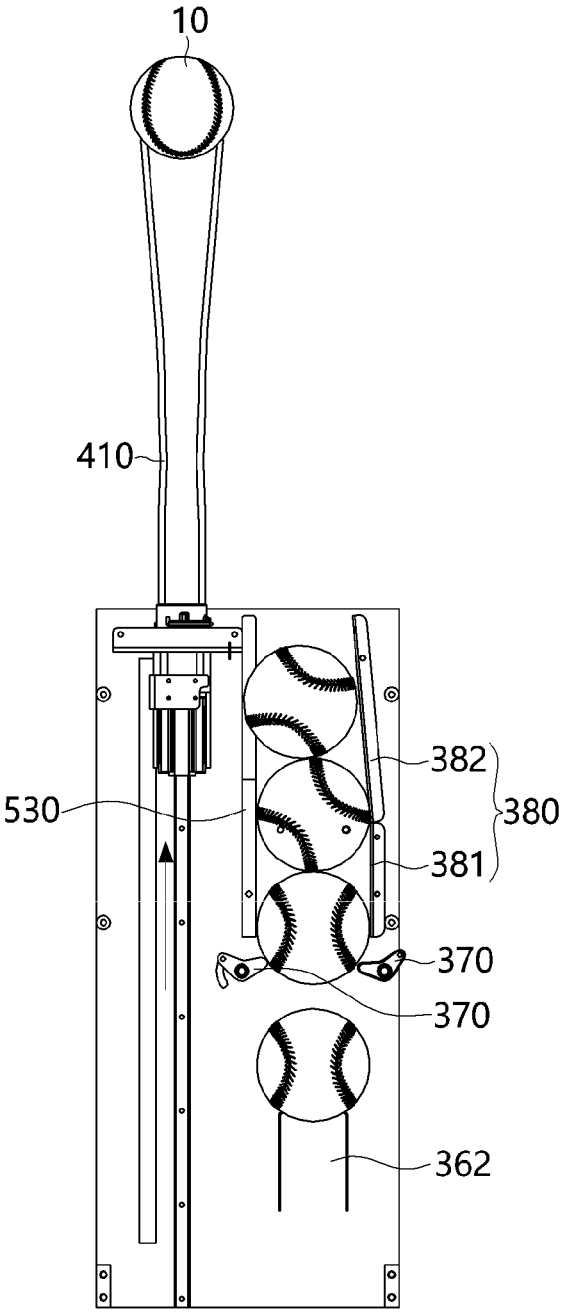

After that, if the ball transfer body 340 moves to a movable height, that is, to the top of the first transfer space, the top portion of the transferred ball 10 pushes the ball 10 located at the lowermost end of the second transfer space upward, and at the same time, the lower portion of the transferred ball 10 is locked onto the locking member 370, as shown in FIGS. 10 and 11.

Through the above-mentioned operations, the plurality of balls 10 are stacked up in the second transfer space, and if the ball 10 is newly introduced from the first transfer space, the ball 10 located at the uppermost end of the second transfer space moves to the ascending/descending module 400.

So as to prevent another ball 10 which is not the ball 10 located at the uppermost end of the second transfer space from moving to the ascending/descending module 400, on the other hand, an intermediate separation plate 530 is disposed on one side of the second transfer space adjacent to the tee stand accommodation space 420.

Further, an escape prevention plate 380 is disposed on the other side of the second transfer space that faces the intermediate separation plate 530 so as to prevent the ball 10 stacked in the second transfer space from escaping in a directing facing the tee stand accommodation space 420, that is, in a direction toward the hopper assembly 200.

In detail, one side and the other side of the plurality of balls 10 stacked in the second transfer space are supported against the intermediate separation plate 530 and the escape prevention plate 380, and especially, the ball 10 located at the uppermost end of the plurality of balls 10 stacked in the second transfer space has to be transferred to the ascending/descending module 400.

To this end, a guide groove 531 is formed on top of the intermediate separation plate 530 to guide the ball 10 to the ascending/descending module 400, and the escape prevention plate 380 includes a lower escape prevention plate 381 formed in the vertical direction and an upper escape prevention plate 382 disposed on top of the lower escape prevention plate 381 in such a manner as to be inclined toward the intermediate separation plate 530 as it goes upwards.

In a process where the ball 10 in the second transfer space moves upwards, in detail, the ball 10 gradually moves toward the intermediate separation plate 530 by means of the guide groove 531 and the upper escape prevention plate 382. If the ball 10 is located at the uppermost end of the second transfer space, it can gently move to the ascending/descending module 400, in detail, to the top of the tee stand 410.

If the ball 10 moves to the top of the tee stand 410, it moves upwards in the state of being seated onto the tee stand 410 by means of the operation of the ascending/descending module 400, and hereinafter, the ascending/descending module 400 will be in detail explained.

The ascending/descending module 400 includes the tee stand 410 as mentioned above and further includes a third motor 540, a first pulley 541, a second pulley 542, a belt member 543, and a bracket 544, which are disposed to ascend and descend the tee stand 410.

The third motor 540 produces power for ascending and descending the tee stand 410 and may be configured to have a reducer.

The first pulley 541 is coupled to the third motor 540 and rotates along with the rotation of the third motor 540. The second pulley 542 is vertically spaced apart from the first pulley 541 above the first pulley 541.

The belt member 543 is adapted to connect the first pulley 541 and the second pulley 542, and if the first pulley 541 rotates along with the rotation of the third motor 540, the second pulley 542 also rotates by means of the belt member 543. The belt member 543 reciprocates up and down around the first pulley 541 and the second pulley 542.

One side of the bracket 544 is fixedly coupled to the belt member 543 and the other side thereof is coupled to the tee stand 410. If the belt member 543 moves, accordingly, the tee stand 410 also moves.

Furthermore, the ascending/descending module 400 has a sensor adapted to detect whether the ball 10 is seated onto the tee stand 410, and the sensor includes a gyro sensor sensing shaking of the tee stand 410 or an optical sensor disposed in the hollow portion at the interior of the tee stand 410 to sense light coming from the upper side thereof.

Also, the tee stand 410 is a consumable item that is worn out according to a period of use and the number of times used, and accordingly, it is desirable that the tee stand 410 is easily exchanged with new one.

To this end, desirably, the tee stand 410 includes a lower tee stand having one side fixedly fastened to the bracket 544 and an upper tee stand having one side separably coupled to the other side of the lower tee stand and a seating groove formed on the other side thereto to seat the ball 10 thereonto.

The lower tee stand and the upper tee stand have to be rigidly coupled to each other so as to resist external impacts applied upon the batter's batting training and at the same time they have to be easily separated and coupled from and to each other by the batter at the time when the exchanging is needed.

For example, the lower tee stand and the upper tee stand are screw-coupled to each other, and so as to prevent the screw coupling from being loosened, a separate pin member is fittedly inserted therebetween.

According to the present invention, on the other hand, the automatic batting training apparatus includes the first motor 240, the second motor 320, and the third motor 540 for correspondingly operating the hopper assembly 200, the transfer module 300, and the ascending/descending module 400, and the first motor 240, the second motor 320, and the third motor 540 are connected wiredly to external power supply parts, so that power can be applied to each motor.

So as to provide easy movements and conveniences in the use of the automatic batting training apparatus, however, a separate power storage part may be desirably disposed on the bottom part 100. Of course, the power storage part can be charged.

Moreover, the control module is provided to control each motor, so that the balls 10 are supplied to the batter at the time point required through the cooperative operations of the respective parts as mentioned above.

Now, an explanation on the driving operation of the automatic batting training apparatus through the control module will be given.

If the ball 10 seated onto the tee stand 410 is hit by the batter, first, the non-existence of the ball 10 on the tee stand 410 is sensed by the sensor, and the sensed information is transferred to the control module.

On the basis of the sensed information, the control module is adapted to supply power to the third motor 540 to allow the tee stand 410 to move down, and at the same time, to supply power to the first motor 240 of the hopper assembly 200 to allow the first motor 240 to rotate by the predetermined angle.

Through the rotation of the first motor 240, the ball 10 disposed on any one of the plurality of ball accommodation holes 222 is moved down and seated onto the seating portion 342 of the transfer module 300 along the ball supply guide 110.

At this time, the control module is adapted to supply power to the second motor 320 to allow the ball transfer body 340 to move upward, and accordingly, the ball 10 seated onto the seating portion 342 is transferred in the upward direction and enters the second transfer space. In this process, the ball 10 pushes upward the ball 10 disposed on the lowermost end of the second transfer space and thus locked onto the locking member 370.

The balls stacked up in the second transfer space are sequentially pushed upward by means of the ball newly entering the second transfer space, and at this time, the ball located on the uppermost end of the second transfer space is moved to the ascending/descending module 400 along the guide groove 531 formed on the intermediate separation plate 530 and is finally seated onto the top of the tee stand 410.

The existence of the ball 10 on top of the tee stand 410 is sensed by the sensor, and if the sensed result is transferred to the control module, the control module applies power to the third motor 540 to allow the tee stand 40 to move upward.

On the other hand, the automatic batting training apparatus according to the present invention can output states and abnormalities of the hopper assembly 200, the driving assembly 500, the control module, and the power storage part, and further includes a touch screen panel through which control commands can be inputted directly by the batter.

As described above, the automatic batting training apparatus according to the present invention is provided with the hopper assembly configured to sequentially discharge the balls stored therein and the tee stand configured to reciprocate up and down in the state of seating the ball onto the top thereof, so that the batter can easily perform the batting training alone.

In addition, the automatic batting training apparatus according to the present invention is configured to allow the transfer module for transferring the ball supplied from the hopper assembly in the vertical direction to be formed integrally with the ascending/descending module having the tee stand disposed therein, thereby minimizing the volume and weight of the apparatus.

Further, the automatic batting training apparatus according to the present invention is provided with the plurality of ball accommodation holes formed on the rotating body of the hopper assembly to allow a plurality of balls to be inserted correspondingly thereinto, thereby sequentially supplying the balls from the hopper assembly.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above teachings. It is therefore intended that the scope of the invention be limited not by this detailed description, but rather by the claims appended hereto.

What is claimed is:

1. An automatic batting training apparatus, comprising:

a bottom part;

a hopper assembly disposed on one side of the bottom part to sequentially discharge a plurality of balls stored therein; and a driving assembly disposed on the other side of the bottom part and comprising a transfer module adapted to transfer the balls discharged from the hopper assembly in a vertical direction and an ascending/descending module having a tee stand disposed movable upward and downward in such a manner as to allow the balls received from the transfer module to be seated one by one onto top thereof to perform tee batting, wherein the driving assembly has a transfer space formed therein in a vertical direction to transfer the balls received from the hopper assembly in the vertical direction and a tee stand accommodation space formed parallel with the transfer space to accommodate the tee stand therein.

2. The automatic batting training apparatus according to claim 1, wherein the hopper assembly comprises:

a hopper case having a hollow portion formed therein to store the balls therein;

a rotating body rotatably disposed in the hollow portion of the hopper case and having a rotating shaft located at the center thereof and a plurality of cylindrical ball accommodation holes radially formed around the rotating shaft;

a support frame having one side coupled to the bottom part and a support plate disposed on the other side thereof in such a manner as to be spaced apart from the underside peripheries of the ball accommodation holes; and a first motor located under the support plate in such a manner as to be connected to the rotating shaft to rotate the rotating body.

3. The automatic batting training apparatus according to claim 2, wherein a distance between the underside peripheries of the ball accommodation holes and the support plate is smaller than a diameter of the ball; the support plate has a ball discharge hole formed on one side thereof to correspond to one ball accommodation hole and a rotating shaft through hole formed on the other side thereof in such a manner as to pass the rotating shaft therethrough; and the hopper assembly has a protruding plate protruding from an inner side of the hopper case corresponding to the ball discharge hole in such a manner as to cover a portion of the top of the ball accommodation hole.

4. The automatic batting training apparatus according to claim 1, wherein the transfer module comprises:

a second motor;

a rotating rod rotating along with the rotation of the second motor and having a screw thread formed on the outer peripheral surface thereof; and a ball transfer body reciprocating up and down along with the rotation of the rotating rod and having a rod accommodation portion formed on one side thereof to accommodate the rotating rod therein and a seating portion formed on the other side thereof to seat the ball discharged from the hopper assembly thereonto.

5. The automatic batting training apparatus according to claim 4, wherein the transfer space of the transfer module is partitioned into a first transfer space in which the ball transfer body reciprocates up and down and a second transfer space formed above the first transfer space, and a locking member is disposed between the first transfer space and the second transfer space to prevent the ball entering the second transfer space through the ball transfer body from falling down.

6. The automatic batting training apparatus according to claim 5, wherein the second transfer space has an intermediate separation plate disposed on one side adjacent to the tee stand accommodation space and an escape prevention plate disposed on the other side facing the intermediate separation plate.

7. The automatic batting training apparatus according to claim 6, wherein the intermediate separation plate has a guide groove formed on top thereof to guide the ball to the ascending/descending module, and the escape prevention plate has a lower escape prevention plate formed in the vertical direction and an upper escape prevention plate disposed on top of the lower escape prevention plate in such a manner as to be inclined toward the intermediate separation plate as the upper escape prevention plate goes upwards.

8. The automatic batting training apparatus according to claim 1, wherein the ascending/descending module comprises:

a third motor;

a first pulley coupled to the third motor and rotating along with the rotation of the third motor;

a second pulley vertically spaced apart from the first pulley above the first pulley;

a belt member adapted to connect the first pulley and the second pulley; and a bracket adapted to move the tee stand up and down along with the rotation of the third motor and having one side fixedly coupled to the belt member and the other side coupled to the tee stand.

9. The automatic batting training apparatus according to claim 1, further comprising:

a control module for controlling at least one of the hopper assembly and the driving assembly; and a power storage part for supplying power to at least one of the hopper assembly, the driving assembly, and the control module.

10. The automatic batting training apparatus according to claim 9, wherein states and abnormalities of the hopper assembly, the driving assembly, the control module, and the power storage part are outputted, the apparatus further comprising a touch screen panel through which control commands are inputted directly by a batter.

* * * * *